US006391154B1

(12) United States Patent
Nygård et al.

(10) Patent No.: US 6,391,154 B1
(45) **Date of Patent: *May 21, 2002**

(54) PAPER WEB AND A METHOD FOR THE PRODUCTION THEREOF

(75) Inventors: Stina Nygård; Markku Leskelä, both of Lohja; Maija Pitkänen, Jyväskylä, all of (FI)

(73) Assignee: M-real Oyj, Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/153,481

(22) Filed: Sep. 16, 1998

(30) Foreign Application Priority Data

Sep. 16, 1997 (FI) ..... 973704

(51) Int. Cl.[7] ..... D21H 11/10; D21H 19/00

(52) U.S. Cl. ..... 162/135; 162/142; 162/147; 162/148; 162/55; 162/70; 162/71

(58) Field of Search ..... 162/135, 141, 162/142, 150, 151, 301, 147, 148, 398, 300, 55, 70, 71, 72, 78, 82, 298; 427/391, 361, 359, 366

(56) References Cited

U.S. PATENT DOCUMENTS

| | | | | | |
|---|---|---|---|---|---|
| 1,624,492 | A | * | 4/1927 | Little et al. | 162/142 |
| 1,824,837 | A | * | 9/1931 | Ritcher | 162/149 |
| 4,298,652 | A | | 11/1981 | Suzuki et al. | 428/323 |
| 4,388,150 | A | * | 6/1983 | Sunden et al. | 162/175 |
| 4,430,159 | A | * | 2/1984 | Bubik et al. | 162/292 |
| 5,118,533 | A | | 6/1992 | Saji et al. | 427/366 |
| 5,158,806 | A | | 10/1992 | Unger | 427/359 |
| 5,582,681 | A | * | 12/1996 | Back et al. | 162/5 |
| 5,599,427 | A | * | 2/1997 | Koivuranta et al. | 162/301 |
| 5,620,565 | A | * | 4/1997 | Lazorisak et al. | 162/72 |
| 5,656,133 | A | * | 8/1997 | Savia | 162/203 |
| 5,679,218 | A | * | 10/1997 | Vinson et al. | 162/109 |
| 5,725,732 | A | * | 3/1998 | Cooper, III | 162/72 |
| 5,766,419 | A | * | 6/1998 | Linsuri et al. | 162/301 |

FOREIGN PATENT DOCUMENTS

| | | |
|---|---|---|
| EP | 0 496 269 | 7/1992 |
| FI | 884196 | 3/1989 |
| GB | 496 775 | 12/1938 |
| GB | 1 001 778 | 8/1965 |
| GB | 1 030 195 | 5/1966 |
| GB | 2 262 542 A | 6/1993 |
| SE | 500 472 | 1/1992 |
| WO | WO 85/03316 | 8/1985 |
| WO | WO 95/28522 | 10/1995 |

OTHER PUBLICATIONS

English Language abstract for Hoydahl, H.–E., "Thermomechanical pulp–fashionable or realistic fiber alternative," Norsk Skogind. 29(12):323–328 (1975).

English Language Abstract for Pisarevskaya, E. A. et al., "Production of bleached aspen groundwood at the Zhidachev Mill," Bumazh. Prom. 1:17–18 (1981).

English Language Abstract for Richardson, C. A., "TMP (Thermomechanical pulp) in coating base stock," CPPA Ann. Mtg. (Montreal) Preprints 63B:49–51 (1977).

English Language abstract for Vulchev, V. et al., "Manufacture of groundwood from chips," Tseluloza Khartiya 9(4):5–9 (1978).

Barzyk, D., et al., "Acidic Group Topochemistry and Fibre–to–Fibre Specific Bond Strength," J. Pulp Paper Sci. 23(2):J59–J61 (Feb. 1997).

Dahlvik, P., et al., "Interactions in Coating Colord Induced by Temperature–Sensitive Cellulosic Polymer," Intl. Paper and Coating Chem. Symp., Ottawa, Canada, pp. 155–162 (Jun. 1996).

Malinen, R., "Recent trends in kraft pulping in Finland," Paper and Timber 75(1–2):14–19 (1993).

Sundberg, K., et al., "Interactions between simple electrolytes and dissolved and colloidal substances in mechanical pulp," Pulp Paper Res. J. 9(2):125–128 (1994).

European Search Report for European Application No. EP 98 66 0001.3.

Patent for Inventions. Abridgments of Specifications, Herlad Printing Works, York, 1954, Abstract for U.K. Patent No. 623,357, p. 39.

Patent for Inventions. Abridgments of Specifications, Herlad Printing Works, York, 1954, Abstract for U.K. Patent No. 609,927, pp. 141–142.

Dialog File 351 (World Patents Index) English language abstract of FI 884196, WPI Accession No. 89–087231/12.

Heikki Liimatainen et al. "Pressurized Grinding Improves the Potential of the Populus Family as a Raw Material for Value Added Papers", SPCI92 Conference in Italy, 1992 (May 19–22, 1992), Bologna Italy).

* cited by examiner

*Primary Examiner*—Jose Fortuna
(74) *Attorney, Agent, or Firm*—Kubovcik & Kubovcik

(57) ABSTRACT

The invention concerns a method for producing a paper web. According to the method a stock is produced from the fibrous raw material and the stock is formed to a web which is dried on a paper machine. According to the invention the stock is formed from a mechanical pulp prepared from wood material of the Populus family and from bleached chemical spruce pulp, whereby the amount of the mechanical pulp is 20 to 70 weight-% and the amount of the bleached chemical softwood pulp is 80 to 30 weight-% of the dry matter of the stock. It is preferred to use an aspen pulp, over 70% of the fiber fractions of which comprise fiber fractions +100, +200 and −200, and the proportion of the −200 fraction is 45% or less. A coated fine paper can be produced from the paper web whose properties are better than those of a traditional fine paper having the corresponding bulk and grammage, on the same capacity level the paper produced by the invention will give a yield gain of up to more than 20%.

25 Claims, No Drawings

PAPER WEB AND A METHOD FOR THE PRODUCTION THEREOF

The present invention relates papermaking. In particular the invention concerns a method for producing a paper web. According to a method of this kind, a fibrous raw material is slushed to form a stock, a web is formed from the stock and the web is dried.

FIELD OF THE INVENTION

Description of Related Art

With the aid of the present invention it is possible to produce a base paper which is particularly well suited to the manufacture of fine paper. The surface weight of a base paper of this kind is generally 20 to 200 g/m$^2$.

High-quality printing matters, such as brochures, advertising materials and catalogues, are made from fine papers which have good opacity, an even surface structure and high brightness.

Traditionally, fine papers have been manufactured from cellulosic hardwood or softwood pulps or mixtures thereof. The problem associated with the known art is that it is not possible at low grammage to reach sufficiently high opacity for the pulp or the paper manufactured therefrom. The formation of the chemical pulp and the paper made from it remains rather poor when high opacity is aimed at.

Light, coated paper qualities containing mechanical pulp are also known in the art. These are manufacture from a mechanical pulp made from spruce and they usually contain about ⅓ to ¼ softwood pulp which reinforces the pulp and improves the strength properties of the paper.

The particular advantages of mechanical pulps in comparison to chemical pulps are their lower production costs and greater yield. The coarse, stiff fibers of the pulp lead, however, to fiber coarsing, which shows in offset printing Further, the disadvantages of groundwood of spruce include its poor dewatering at low drainability and the large energy consumption of the whole pulping process. A problem of known papers based on groundwood is also their low brightness and poor brightness stability. They are not either shelf stable if spruce GW has been used.

Paper qualities containing mechanical pulps and combinations of mechanical pulps and chemical pulps, respectively, have not been used for fine papers. Instead, said types of papers (e.g. LWC) are primarily used as magazine papers.

BRIEF SUMMARY OF THE INVENTION

It is an object of the present invention to eliminate the problems of the prior art and provide a solution for producing a base paper suitable for the manufacture of fine papers. It is also an object of the present invention to provide a fine paper of a novel kind, having the high brightness and good smoothness of traditional fine papers and which further exhibits the good opacity and excellent printability due to the good formation characteristic for mechanical printing papers.

DETAILED DESCRIPTION OF THE INVENTION

The present invention is based on the concept of combining groundwood of hardwood and chemical pulp of softwood and of producing a base paper from a mixture of the mechanical and the chemical pulp. In connection with the present invention it has been found that a mechanical pulp (in particular Pressure Ground Wood, PGW) manufactured from aspen and other wood species of the Populus family contain a great amount of short fibers which improve the traditionally insufficient bulk and light scattering of fine paper. Although the strength properties of aspen GW, as regards, for example ScottBond strength, are not entirely sufficient, by combining aspen GW with a chemical pulp produced from softwood, it becomes possible to produce a basepaper which exhibits excellent opacity at high brightness and an even surface and good strength. Due to the good bonding strength of softwood, aspen GW can be used in an amount of up to 30 to 70% of the dry weight of the pulp.

More specifically, the solution according to the present invention is mainly characterized in that the stock is formed from a mechanical pulp of a wood raw material of the Populus family and a bleached chemical softwood pulp, the amount of mechanical pulp being 20 to 70wt-% and the amount of bleached softwood pulp being 80 to 30 weight-% of the dry matter of the stock.

Considerable advantages are obtained by means of the invention Thus, using the base paper according to the invention it is possible to obtain better opacity on the same level of brightness as that exhibited for traditional fine papers. The paper contains more fines and its bulk and opacity are greater, which gives it good printing properties, Surprisingly, we have found that by means of the present invention it has become possible at lower grammage to produce a fine paper having an extremely high brightness. When the fine papers produced from the present base paper are compared with traditional fine papers, thanks to the low grammage, a yield gain of up to about 20% can be obtained; on the same opacity level the present paper will give more printing surface per weight unit than traditional fine papers.

The short-fibered aspen gives the paper good light scattering properties.

According to the invention it is therefore possible to provide a paper which fulfills all the quality requirements of coated fine papers consisting solely of chemical pulp but which, at the same time, provides high opacity and bulk and excellent printability properties.

In the following, the invention, its features and benefits will be examined in greater detail with reference to a detailed description and a number of working examples.

The fiber structure of aspen and wood species belonging to the same family differ from the fiber structures of the hardwood species most frequently used for pulp making, such as birch. The dimensions of the aspen fiber, the fiber length and width are smaller than for spruce and birch The tracheids of aspen are smaller (length 0.9 mm) than the tracheids of birch (1.0–1.1 mm). In both, the proportion of vasculum cells is about 25%. Traditionally, the tubular cells contained in aspen have been considered to cause runability problems on the paper machine and they have not been believed to provide for bonding. As a result of the short fibers and the poor bonding of the vasculum cells, dusting of the paper can occur on the paper machine and during posttreatment.

According to the present invention it has now surprisingly been found that by using a combination of mechanical pulp produced from aspen and chemical softwood pulp, the runability problems caused by the tubular cells can be avoided and a pulp can be produced which has impeccable strength properties. Since the aspen pulp has shorter fibers than the birch pulp and even much shorter than spruce, at a given grammage there are more aspen fibers than birch or spruce fibers. This leads to a greater light scattering coefficient and bulk in the present invention. Further, the advantageous fiber length distribution gives the paper an excellent formation i.e. variation of the grammage of paper on a small scale, typically <3 g/m$^2$. The smoothness of the paper is also good.

Due to all these factors, it is now possible to achieve a base paper which can be coated for production of high-quality line papers, which have excellent printability properties The advantages of the special aspen pulp in comparison to spruce groundwood comprise high brightness and brightness stability. The stability of the brightness is in particular due to the low lignin-content of aspen groundwood or corresponding mechanical pulp and to the low concentration of carbonyl groups compared to spruce groundwood. Further, it should be pointed out that a paper web produced from aspen has clearly better dewatering properties than a web produced from spruce. The shorter dewatering time and the higher dry matter content together give a sheet with more porosity.

The greatest advantage of the fiber distribution of aspen is obtained when the pulp has been beaten to the drainability of fine papers. It should be mentioned that spruce has to be refined to a higher degree of beating because of the stiff fibers contained therein. The long and stiff fibers of mechanical pulps produced from spruce cause a coarsing of the paper surface fibers during coating and, in particular, during printing. The phenomenon is rather typical for mechanical printing papers and it substantially deteriorates the quality of the printing surface. The requirements for the printing surface of fine papers are very strict and no coarsing of the paper surface is acceptable. With the particular aspen pulp according to the present invention, not fiber coarsing problems occur, which relates to the fact that practically all long and stiff fibers of the +14 and +28 fractions have been eliminated.

As an example of the fiber length distribution of aspen, the following table can be presented which indicates the fiber fractions retained by various sieves (mesh). The determination have been made from dosing pulps and the table compares aspen fibers to birch and spruce fibers, respectively:

TABLE 1

| Fiber fractions | Aspen PGW | Birch pulp | Spruce PGW |
|---|---|---|---|
| +14 | 0% | 0.1% | 0.4% |
| +28 | 1.6% | 7.8% | 10.6% |
| +48 | 16.0% | 42.3% | 21.8% |
| +200 | 43.0% | 36.5% | 33.5% |
| −200 | 39.4% | 13.3% | 33.7% |
| Freeness, CSFml | 50 | | 30 |
| Pulmac shives 0.8mm/mg/g | <0.2 | 0 | 1 |

The average fiber length of aspen of PGW is smaller than of spruce (FS is typically about 0.54±0.01).

Preferably the mechanical aspen pulp contains about 10 to 20% of +20 . . . +48 mesh fibers, which confer mechanical strength to the pulp. In order to maximize light scattering, the portion of +100, +200 and −200 fractions should be as large as possible. Preferably they stand for distinctly more than 50% of the whole pulp. In particular their proportion of the whole pulp is over 70%, preferably over 80%. On the other hand, the amount of the smallest fraction, i.e. the 200 mesh, should not be too large, because then dewatering on the paper machine would become more difficult. Preferably the proportion of this fraction is smaller than 50%, in particular 45% or less.

The proportion of +14 and +28 mesh fiber fractions are below 10%, preferably below 5%, and in particular below 3%. The amounts of Pulmac shives at 0.8 mm/mg/g are below 1, in particular below 0.5.

In addition to the aspen mentioned above, pulp produced from any mechanical pulp made of a tree of the Populus family can be used for the base paper. Suitable species are, for example, *P. tremula, P tremuloides, P balsanea, P. balsamifera, P. trichocarpa* and *P. heterophylla*. A preferred embodiment comprises using aspen (trembling aspen, *P. tremuta*; Canadian aspen, *P. tremuloides*), or aspen varieties known as hybride aspens produced from different base aspens by hybridizing as well as other species produced by recombinant technology, or poplar. The raw material is processed to groundwood (GW) or pressure groundwood (PGW) or it is disintegrated to chips and the chips are used for producing thermomechanical pulp (TMP) of chemimecbanical pulp (CTMP) in a manner known per se.

The mechanical pulp is bleached after grinding or refining, respectively. Preferably the pulp is peroxide bleached at alkaline conditions. According to a preferred embodiment the pulp is bleached with a one, two or multi-stage bleaching sequence, the pulp being acidified between the bleaching stages and the peroxide residue being reduced. Generally the peroxide dosage is about 2 to 3.5 weight-% of the dry matter of the pulp, for aspen pulp 0.5 to 1.5%, in particular 0.7 to 1.2%. A dithionite bleaching step comprising the treatment of the pulp with $Na_2S_2O_4$ can be incorporated into the peroxide bleaching sequence.

The mechanical pulp is washed before bleaching and after the bleaching with a mixture of water from the pulping section and a clarified recirculation water of the paper machine in a washing press (fabric press) by using typically about 0.1 to 10 m$^3$ water per ton of pulp. By using the washing press water is removed from the pulp in order to increase the dry matter content of the pulp to about 20 to 30%. The waters from the dewatering are recycled to the production of the mechanical pulp. By the washing press it is possible to prevent impurities from being transferred to the paper machine.

The bleached pulp is then refined to the desired degree of beating, which is, e.g. 30 to 100 CSF, preferably about 40 to 80 CSF.

A stock is formed from the mechanical pulp together with a chemical pulp. The stock can contain other fiber materials and additives, such as fillers. Calcium carbonate is an example of a filler. The dry matter content of the stock is about 0.1 to 5% Clarified filtrate of a circulating water of the paper machine is used as the aqueous phase of the stock The chemical pulp used comprises in particular a fully bleached chemical softwood pulp, whereby a paper web suitable as a base paper of fine papers is obtained. Said web has high bulk, high brightness and high opacity and good formation. The amount of the mechanical pulp is then for example 20 to 70 weight-%, preferably 30 to 60 weight-%, and the amount of the bleached softwood pulp is for example 80 to 30 weight-%, preferably 70 to 40 weight-% of the dry matter of the stock.

Preferably the chemical pulp used for the preparation of the base paper is produced by method known as a modified batch-type cooking (Superbatch Cook). This cook is discribed in literature [cf., for example, Malinen, R. Paperi ja Puu (Paper and Timber), 75 (1993) 14–18]. The cook in question is a modified cooking method which utilizes an alkaline cooking liquor just as the sulphate cook, but wherein delignification has been enhanced so that the kappa number of the chemical pulp is lowered without a significant reduction of viscosity. Typically with a Superbatch process, pulp is cooked to a kappa number of 20 or less.

A paper web is formed from the stock of aspen pulp and chemical pulp on a paper machine. Preferably a gap former is used for web forming. In said technique the web is dried between two webs, water being removed in both directions. Thus, as regards printability, an advantageous distribution of the fines is obtained in the direction of the Z axis; the fines are gathered on both surfaces of the base paper web. A "smiling" distribution is formed in transversal direction when the fines accompany the leaving water. A paper according to the invention contains substantially much more fibes than for example a traditional spruce groundwood-based LWC. The fines of the aspen and the fillers added to the stock are accumulated on the surfaces of the paper. Because aspen has a rather good brightness and a good brightness stability, it is possible to get abundant amounts of aspen fibers on the surface of the paper. The coating is also accumulated on the surface of such a paper and, thus, a good coverage can be obtained. Therefore, by combining the use of a gap former with the present fiber mixture it is possible to provide a base paper which has rather advantageous printing properties after coating.

As regards the runability of the above-described fiber mixture it is particularly advantageous to set the dosing pH of the stock at 6.8 to 7.2 and the pH of the machine pulp at 7.1 to 7.5, preferably at about 7.1 to 7.3.If necessary a suitable base or acid is used for setting the pH and for adjusting the pH during paper making. The bases used comprise in particular alkali metal bicarbonates or carbonates and alkali metal hydroxides. The acids used include mineral acids and acid salts. The preferred acids are sulphuric acid and its acid salts such as alum, and the preferred base is sodium bicarbonate. The consistency of the headbox is adjusted to 0.6 to 0.8.

By using the invention, the following properties can be obtained for the base paper:

| | |
|---|---|
| Fiber composition: | 30 to 60 weight-% mechanical aspen pulp (aspen groundwood)<br>70 to 40 weight-% chemical softwood pulp (bleached chemical pine pulp) |
| Grammage: | 30 to 200 g/m$^2$ |
| Bulk: | 1.2 to 1.6 cm$^3$/g |
| Opacity: | over 78% (at a grammage of 50 to 110 g/m$^2$ over 87%) |
| Brightness: | over 78% (at a grammage of 50 to 110 g/m$^2$ over 82%) |

From a base paper of this kind a high-quality fine paper can be produced by coating it twice with a suitable coating colour containing pigments. The coating colour can be applied on the material web in a manner known per se. The method according to the invention for coating paper and/or paperboard can be carried out on-line or off-line by using a conventional coater, i.e. a doctor blade coater, or by film press coating or by surface spraying According to a particularly preferred embodiment, the paper web is double-coated, whereby the first coating is for example carried out by the film press method, and the second coating is performed by doctor blade coating. The precoating is preferably performed by film press coating e.g. at high speed (at least 1450 m/s, preferably even 1600 m/min or more). Generally, the amount of coating colour applied to the web by the film press method is typically about 5 to 50 g coating colour/m$^2$, whereas the corresponding amount for doctor blade coating is 10 to 60 g coating colour/m$^2$. The coating weights have been calculated from the dry matter of the coating colour.

The solution according to the invention is particularly well suited to coating by using in the coating colour a pigment with a steep distribution whereby the pigment will provide good coverage and the paper will have good opacity. By steep pigment size distribution is meant a distribution in which a maximum of 35% of the particles are smaller than 0.5 $\mu$m and preferably a maximum of 15% are smaller Man 0.2 $\mu$m.

After coating and supercalendering the fine paper obtained typically has the following properties:

| | |
|---|---|
| Grammage: | 50 to 220 g/m$^2$ |
| Bulk: | 0.7 to 0.9 cm$^3$/g |
| Opacity: | over 90% (at a grammage of 50 to 110 g/m$^2$ over 94%) |
| Brightness: | over 90% (at a grammage of 50 to 110 g/m$^2$ over 92%) |
| Smoothness: | less than 1 $\mu$m |
| Gloss: | over 70% |

The following examples illustrate the invention. The paper properties indicated in the examples have been measured using the following standard methods:

Brightness: SCAN-P3:93 (D65/10°)

Opacity: SCAN-P8:93 (C/2)

Smoothness: SCAN-P76:95

Bendtsen coarseness: SCAN-P21:67

Gloss: Tappi T480 (75°) and T653 (20°)

EXAMPLE 1

Manufacture of Aspen Groundwood on a Pilot Apparatus

Pressure groundwood was prepared with a pressurized PGW70 process. The pulps were ground with a grinding stone having an average grain size of 73 mesh The grindings were carried out with a one oven pilot grinder. The grinder was operated using the following settings:

Inner pressure of grinder: 250 kPa,

Flow of water jet: about 3.5 l/s (aimed consistency about 1.5 %)

Temperatuer of water jet: 70° C.

The ground pulp was processed to a finished, bleached and postrefined pulp. The processing was performed sequentially as follows:

Mainline screening;

High-consistency refining of reject in two stages;

Screening of refined reject;

Combination of mainline and reject line accepts;

Two-stage bleaching with peroxide+dithionite;

Postrefinings

The screening of the pulp was made using fractionating slit screening technique. The refining of the reject was carried out at high consistency in two stages. In both refining stage the reject was precipitated before grinding with a twin fabric press and diluted after the grinding with the effluent of the press. The reject refiner was provided with knives for high-consistency refining of pulp. Samples were taken after both refining steps. After the first step the sample was subjected to disintegration on a sample web and after the second step the disintegration was made in a container. The paper technical properties were only determined from the sample taken after the second refining step. The screening of the refined reject was made in a manner known per se.

The pulps were bleached with a two-stage peroxide and hydrosulphide bleaching in two batches.

First the pulp which were to be bleached were precipitated on a belt filter, and then they were fed to a high-consistency refiner operated with a rather large knife slit which was used as a chemical mixer. The peroxide solution which contained all bleaching chemicals was fed as screw water of the feed screw of the refiner. From the refiner the pulp was filled into large sacs in which the pulp was kept for about two hours.

The aimed bleaching chemical dosage (90% of production) was:

| | |
|---|---|
| $H_2O_2$ | 1.5%, usually 0.8–1% |
| NaOH | 1.0% |
| $Na_2SiO_3$ | 3.5% |
| DTPA | 0.5% |

DTPA was dosed mixed with the bleaching liquid.

The acidification of the pulp was carried out with a 93% sulphuric acid which was diluted with water at the ratio 1:10. The diluted acid was dosed to the bleaching pulp 8 l per sac.

From the slushed and acidified pulp, CSF, shives, BmcN-fractions and brightness were determined. During double-bleaching the peroxide residue was reduced after acidification by adding to the pulp in a pulper 1.33 kg sodium sulphite per sac. Then the pH was set at 6.5 by adding 50% sodium hydroxide. In the previous test runs the aimed pH value was 6.0.

After this, a 10% $Na_2S_2O_4$ solution was added for performing the dithionite bleaching. The dosing was 0.6%. From the second bleaching batch pulp and paper technical properties were determined after double bleaching.

The postrefining was carried out at low consistency with a Tampella T224 disc refiner. The pulp was refined at about 70 kWh/t specific energy consumption. The drainage of the finished pulp was 50 ml CSF.

The fiber size distribution of the pulp was the following:

| Fiber fraction | Percentage |
|---|---|
| +14 | 0% |
| +28 | 1.6% |
| +48 | 16.0% |
| +200 | 43.0% |
| −200 | 39.4% |

EXAMPLE 2

Preparation of Base Paper for Fine Papers

A base paper was produced from a mechanical aspen pulp (GW) and chemical pine pulp, which were mixed at a weight ratio of 40 to 60. Ground calcium carbonate was added as a filler to the suspension in an amount of about 10% of the fibrous material.

The base paper was produced on a gap former. The properties of the base paper were the following:

| | |
|---|---|
| grammage | 53.3 g/m$^2$ |
| bulk | 1.45 cm$^3$/g |
| opacity | 88% |
| brightness | 82.5% |
| coarseness | 240 ml/min |
| porosity | 170 ml/min |
| filler content | 12% |

Comparative test carried out in connection with the invention have shown that the grammage of the base paper is at least 10% smaller than that of a base paper produced entirely from a bleached chemical pulp and having the corresponding opacity and brightness.

EXAMPLE 3

Production of Fine Papers

A base paper produced according to Example 2 was coated twice, first with the film press method and then with doctor blade coating.

A calcium carbonate pigment having the particle size distribution shown in Table 2 was used in the coating colours:

TABLE 2

Particle size distribution of the carbonate pigment

| Max. particle size [μm] | Cumulative proportion of weight |
|---|---|
| 5 | 99 |
| 2 | 95 |
| 1 | 70 |
| 0.5 | 35 |
| 0.2 | 10 |

The coating colour was produced in a manner known per se by mixing together the pigment, the binder and the other additives. The dry matter content of the precoating colour was 60% and of the surface coating colour 61%. The above described colours were used for coating the afore-mentioned base paper in the following conditions:

Precoating by the film press method 9 g/m$^2$ per side; and the surface coating at a doctor blade station: 10.5 g/m$^2$ per side at a speed of 1500 m/min. The coated paper was super-calendered.

The properties of the end products were determined and compared to those of two commercially available finer papers, viz. Lumiart (Enso) and Nopacoat (Nordland Papier). The results will appear from Table 3:

TABLE 3

Optical properties of a double-coated fine paper

| | Paper according to the invention | Lumiart | Nopacoat |
|---|---|---|---|
| Grammage [g/m$^2$] | 80 | 100 | 99 |
| Bulk | 0.85 | 0.83 | 0.78 |
| Opacity [%] | 94 | 92.7 | 92.6 |
| Brightness [%] | 94 | 91 | 96.7 |
| Smoothness pps 10 [μm] | 0.8 | 1.2 | 0.8 |
| Gloss [%] | 73 | 66 | 71 |

Table 3 shows that the properties of a fine paper produced by the invention are better in all respects than those of comparative papers having corresponding bulk and grammage. On an equal level of opacity the yield gain is even more than 20%.

What is claimed is:

1. Method of producing a coated fine paper, comprising forming a stock from a) a pressure ground wood pulp of a wood raw material of the Populus family, about 10 to 20% of the fiber sizes of the pressure ground wood pulp being between +28 and +48 mesh, and the fiber fractions +100, +200 and −200 being more than 50% of the fiber fractions of the pulp, and b) a bleached chemical softwood pulp, wherein the amount of pressure ground wood pulp is 20 to 70 weight-% and the amount of bleached softwood pulp is 80 to 30 weight-% of the dry matter of the stock, forming the stock into a web and drying the web to form a base paper having a grammage of 30 to 200 g/m$^2$, and coating the base paper to produce a coated fine paper having a grammage of 50 to 220 g/m$^2$ and exhibiting an opacity over 90%, a brightness over 90% and a gloss over 70%.

2. The method of claim 1, wherein 30 to 60 weight-% of the dry matter of the pulp is pressure ground wood pulp and 70 to 40 weight-% is chemical softwood pulp.

3. The method of claim 1, wherein the pressure ground wood pulp is from *P. tremula, P. tremuloides, P balsamea, P. balsamifera, P. trichocarpa* or *P. heterophylla.*

4. The method of claim 1, wherein the pressure ground wood pulp is produced from aspen (*P. tremula*), Canadian aspen (*P. tremuloides*) or hybrid aspens.

5. The method of claim 1, wherein the fiber fractions +100, +200 and −200 are more than 70% of the fiber fractions of the pulp and the proportion of the −200 fraction is 45% or less.

6. The method of claim 1, wherein the fiber fractions +100 , +200 and −200 are more than 80%.

7. The method as in claims 1, 2, 3, 4, 5 or 6, wherein the web is formed with a gap former.

8. The method of claim 1, 2, 3, 4, 5 or 6, wherein bleached pressure ground wood and full bleached chemical pulps are used.

9. A coated fine paper prepared according to the method of claim 1, 2, 3, 4, 5 or 6, wherein 30 to 60 weight-% of the fibers are from a pressure ground wood aspen pulp, 70 to 40 weight-% from chemical softwood pulp, and the grammage is 30 to 200 g/m$^2$ and the bulk is 1.2 to 1.6 cm$^3$/g.

10. The coated fine paper of claim 9, wherein fines are distributed at both surfaces of the paper.

11. The coated fine paper of claim 10, wherein both fines and filler contained in the stock are distributed at said surfaces of the paper.

12. The coated fine paper of claim 11, wherein variation of the grammage within the paper is less than 3 g/m$^2$.

13. The coated fine paper of claim 10, wherein variation of the grammage within the paper is less than 3 g/m$^2$.

14. The base paper of claim 9, wherein variation of the grammage within the paper is less than 3 g/m$^2$.

15. The coated fine paper of claim 9, wherein the web is formed with a gap former.

16. The coated fine paper of claim 9, wherein bleached pressure ground wood and full bleached chemical pulps are used.

17. The coated fine paper prepared according to the method of claim 1, 2, 3, 4, 5 or 6, wherein the coating is a double coating and at least one of the coating layers is formed from a coating colour containing a pigment having a particle size distribution in which a maximum of 35% of the particles are smaller than 0.5 $\mu$m and a maximum of 15% are smaller than 0.2$\mu$m.

18. The coated fine paper of claim 17, wherein the web is formed with a gap former.

19. The coated fine paper of claim 18, wherein fines are distributed at both surfaces of the paper.

20. The coated fine paper of claim 18, wherein variation of the grammage within the paper is less than 3 g/m$^2$.

21. The coated fine paper of claim 17, wherein bleached pressure ground wood and full bleached chemical pulps are used.

22. The coated fine paper of claim 21, wherein both fines and filler contained in the stock are distributed at said surfaces of the paper.

23. The coated fine paper of claim 21, wherein variation of the grammage within the paper is less than 3 g/m$^2$.

24. The coated fine paper of claim 17, wherein 30 to 60 weight-% of the fibers are from a pressure ground wood aspen pulp, 70 to 40 weight-% from chemical softwood pulp, and the grammage is 30 to 200 g/m$^2$ and the bulk is 1.2 to 1.6 cm$^3$/g.

25. The coated fine paper of claim 24, wherein variation of the grammage within the paper is less than 3 g/m$^2$.

* * * * *